United States Patent [19]

Resan

[11] Patent Number: 4,660,347

[45] Date of Patent: Apr. 28, 1987

[54] NON-PENETRATING ROOFING MEMBRANE FASTENER

[75] Inventor: Stevan A. Resan, Carlisle, Pa.

[73] Assignee: Carlisle Corporation, Cincinnati, Ohio

[21] Appl. No.: 772,146

[22] Filed: Sep. 3, 1985

[51] Int. Cl.[4] ..... E04D 5/14

[52] U.S. Cl. ..... 52/713; 52/741; 52/747; 52/410

[58] Field of Search ..... 52/410, 741, 747, 748, 52/595, 713, 222; 285/94; 160/399, 380, 402; 24/113, 90 C, 461, 462

[56] References Cited

U.S. PATENT DOCUMENTS

| | | | |
|---|---|---|---|
| 2,302,341 | 11/1942 | Nash | 24/479 |
| 2,456,234 | 12/1948 | Young | 285/94 |
| 2,640,238 | 6/1953 | Schuhr | 24/113 R |
| 2,888,730 | 6/1959 | Nash | 24/465 |
| 3,203,304 | 8/1965 | Rapata . | |
| 3,283,383 | 11/1966 | Heath . | |
| 3,426,412 | 2/1969 | Streng et al. | 24/462 |
| 4,170,810 | 10/1979 | Peleg . | |
| 4,221,028 | 9/1980 | Fischer . | |
| 4,502,256 | 3/1985 | Hahn | 52/410 |
| 4,519,172 | 5/1985 | Ristow | 52/410 |
| 4,519,175 | 5/1985 | Resan . | |
| 4,586,301 | 5/1986 | Hickman | 52/410 |

FOREIGN PATENT DOCUMENTS 2804962 8/1980 Fed. Rep. of Germany .

*Primary Examiner*—John E. Murtagh
*Assistant Examiner*—Caroline D. Dennison
*Attorney, Agent, or Firm*—Wood, Herron & Evans

[57] ABSTRACT

A fastener adapted to secure a roof membrane to a roof surface without penetration of the membrane includes an anchor disc having an inverted frustoconical button, an externally threaded tined retainer adapted to fit over the button with the membrane trapped between the retainer and the button and an internally threaded cover adapted to screw over the retainer and hold it in place over the button. The anchor disc includes a plurality of ribs which extend from the base up to the button. The tined retainer includes a number of tines corresponding to the areas between the individual ribs so that one tine fits between each pair of adjacent ribs. These ribs thereby prevent the rotation of the retainer when the cover is screwed over the retainer. The retainer also includes an upper ring portion and a lower tined portion which permits the tines to flex outwardly but not upwardly. Therefore the threads on the tined portion cannot become misaligned. The ring portion also includes an upper peripheral ridge or a thread which permits the cover to be pre-threaded onto the retainer prior to assembly. This pre-threading does not interfere with the flexibility of the tines since the ridge is up at the top portion of the ring above the tined portion. The tined portion can also be flared outwardly to facilitate easier placement of the retainer over the membrane and button.

19 Claims, 11 Drawing Figures

FIG. 6a
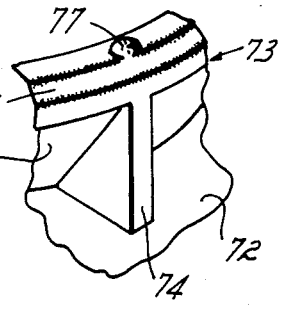
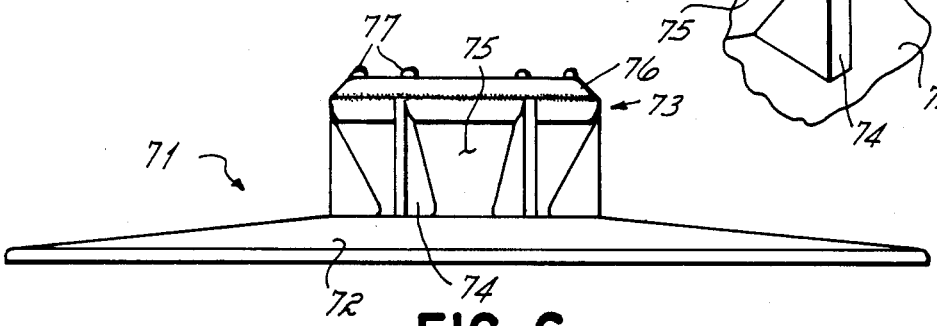
FIG. 6
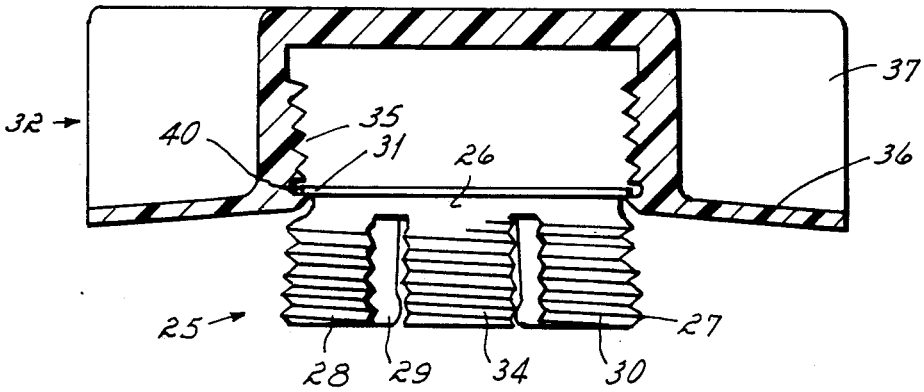
FIG. 9

NON-PENETRATING ROOFING MEMBRANE FASTENER

The present invention relates to a fastener for holding a flexible roofing membrane to a roof, and more particularly to a fastener for attaching a roofing membrane to a roof wherein stress on the membrane is reduced and the potential for rupturing the membrane is reduced.

Further the present invention relates to a three piece fastener which holds a roof membrane to a roof without penetrating the membrane.

BACKGROUND

There are many types of roofing systems used with various types of buildings. For larger buildings with generally flat roofs, a roofing system employing flexible sheet material, for an example EPDM rubber sheeting or membrane, as the upper surface is becoming increasingly popular due to its many advantages. These membranes are generally secured to the roof in four manners, ballast, adhesion, penetrating fasteners and non-penetrating fasteners. Ballast can shift in high winds and is not suitable by itself. Adhering the membrane to the roof is extremely expensive. Penetrating fasteners create holes through the membrane which must be sealed and increase the likelihood of leakage. Non-penetrating mechanical fasteners are inexpensive and do not create holes through the membrane. For these reasons the non-penetrating fasteners are gaining in popularity.

One particular non-penetrating mechanical fastening system is disclosed in German Patentschrift No. 2,804,962 and a modified version of this disclosed in U.S. Pat. No. 4,519,175, the disclosure of which is incorporated herein by reference. With this system the membrane is held to anchoring discs fastened to the roof. Anchoring discs which includes raised, hollow, inverted frusto-conical buttons are screwed or nailed to the roof. The roof membrane is laid over the roof and over these anchoring discs. An externally threaded tined retainer cap is then forced over the buttons with the membrane held therebetween. The tines of the retainer caps deflect outwardly to permit them to fit over the button and membrane. An internally threaded cover screws onto the externally threaded retainer cap with the lower ends of the tines projecting into the region below the upper section of the button, holding the tines in place and preventing the retainer cap from popping off. Thus, the membrane is anchored to the roof without puncturing the membrane.

There are several potential disadvantages with this particular fastener. As the cover is screwed onto the retainer, the retainer cap may rotate with the cover as it is being screwed down. This rotation of the retainer cap would unduly stress the membrane increasing the likelihood of ripping the membrane.

Further, the internal diameter of the retainer cap is smaller than the external surface of the upper rim of the button. The tines are required to flex outwardly to a large degree during installation in order to permit it to fit over the button and the membrane. If done improperly this causes the tines to scrape the membrane as the retainer cap is placed over the membrane and button in some cases, tending to rip the membrane. Also the top rim of the button in the past has been flat. When the retainer cap is pushed over the button it engages the membrane at the top rim and stresses the membrane as it is forced over the button.

Further, as the retainer cap is forced over the membrane the individual tines are free to move upwardly. Different tines may move upwardly to different extents such that threads on adjacent tines are not aligned. The external threads on the tines being out of alignment prevent or hinder screwing the cover over the retainer cap.

These fasteners are basically three piece fasteners with the anchoring disc fixed to the roof substrate and the membrane placed over the anchoring disc. The retainer cap is then placed over the membrane and the anchoring disc and finally the cover is placed on and screwed onto this retainer cap. This is a relatively inconvenient method of securing a membrane to a roof which requires several pieces to be assembled at the building site.

SUMMARY OF THE INVENTION

Accordingly, it is an object of the present invention to provide a fastener having an anchoring disc with an inverted conical button, an externally threaded tined retainer and a cover adapted to screw onto the retainer wherein the retainer is prevented from rotating while the cover is screwed onto the retainer. This objective, in a preferred form of the present invention is achieved by providing ribs between the base of the anchoring disc and the button which are adapted to be located between the individual tines of the retainer to thereby prevent the rotation of the tined retainer when the cover is screwed over the tined retainer.

Further it is an object of the present invention to provide a means to facilitate proper orientation of the tines and ribs when a roof membrane is covering the anchoring disc, to thereby enable the tined retainer to be properly angularly aligned relative to the button so that when the retainer is applied to the button the tines will enter the spaces between adjacent rib pairs. This objective is accomplished by providing the upper rim or lip of the button with vertically extending projections or bosses at circumferential locations corresponding to the rib locations. When the membrane is located over the button, the vertical projections produce visually and/or tactually perceptible bumps in the membrane at locations corresponding to the ribs, thereby locating same to facilitate proper orientation of the tines relative to the ribs.

It is a further object of the present invention to provide a tined retainer wherein the individual tines cannot be forced out of alignment, thereby misaligning the threads on adjacent tines, when the retainer cap is pushed over the button with the roofing membrane sandwiched therebetween. This is accomplished by providing a tined retainer wherein the tines extend only partially along the side wall of the retainer. This leaves a solid ring or band above each tine preventing it from moving straight upwardly. Therefore the threads on a tine are maintained in alignment with threads on adjacent tines.

It is further an object to reduce stress on the membrane as the retainer cap is forced over the button with the membrane trapped therebetween. This is accomplished by forming the button on the anchor disc with an upper tapered rim to guide the tines of the retainer over the button. This is further accomplished by providing a retainer which is flared outwardly. This allows the retainer to be forced over the button with the membrane trapped therebetween without unduly stressing the membrane.

It is further an object of the present invention to reduce field assembly time of the fastener. This is accomplished by providing a retainer which can be pre-threaded onto the cover wherein the pre-threading does not interfere with the flexibility of the individual tines and wherein the individual tines are prevented from becoming misaligned when placed over an anchoring disc.

These and other objects and advantages will be appreciated by reference to the following description and drawings in which:

BRIEF DESCRIPTION OF THE DRAWINGS

FIG. 6 is a view similar to FIGS. 4 and 5 of another alternate embodiment of an anchoring disc for use in the present invention;

FIG. 6*a* is a fragmentary perspective view of the top of the anchoring disc of FIG. 6;

FIG. 9 is a cross-sectional view partly in elevation showing a cover pre-threaded onto a tined retainer cap.

DETAILED DESCRIPTION

Figure 1:
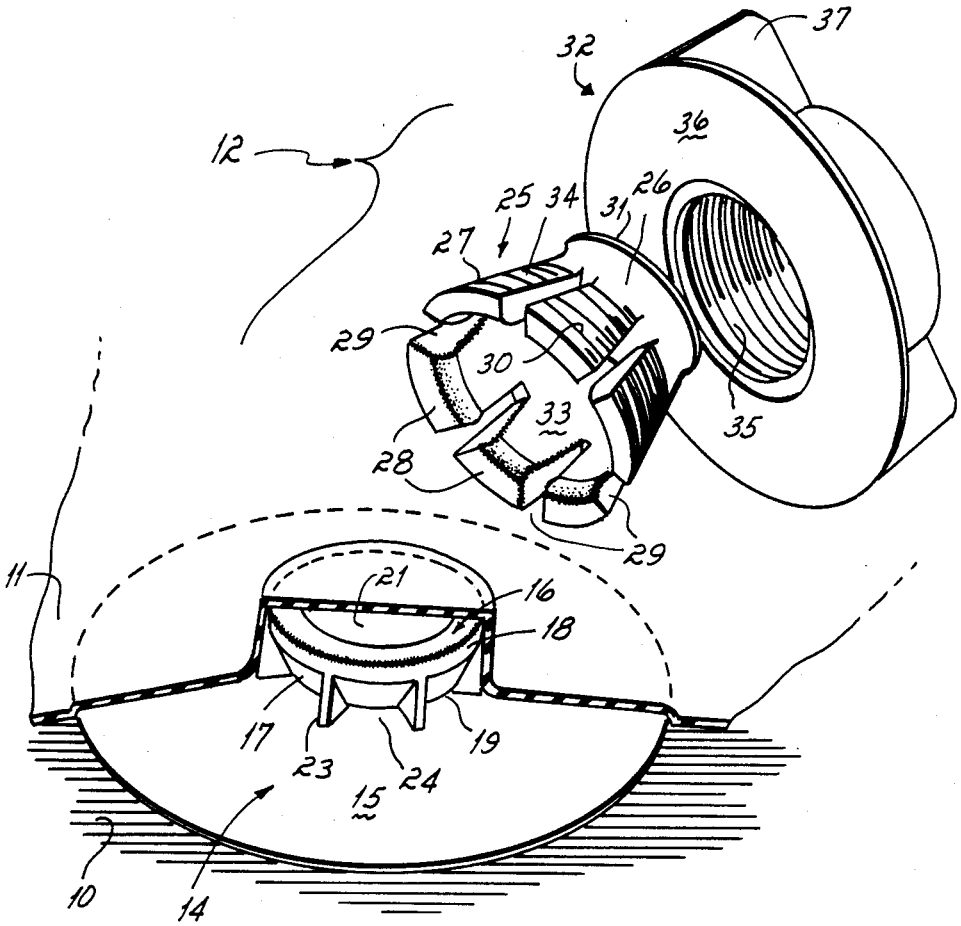
FIG. 1 is an exploded diagrammatic depiction of the use of the fastener of the present invention.
Figure 2:
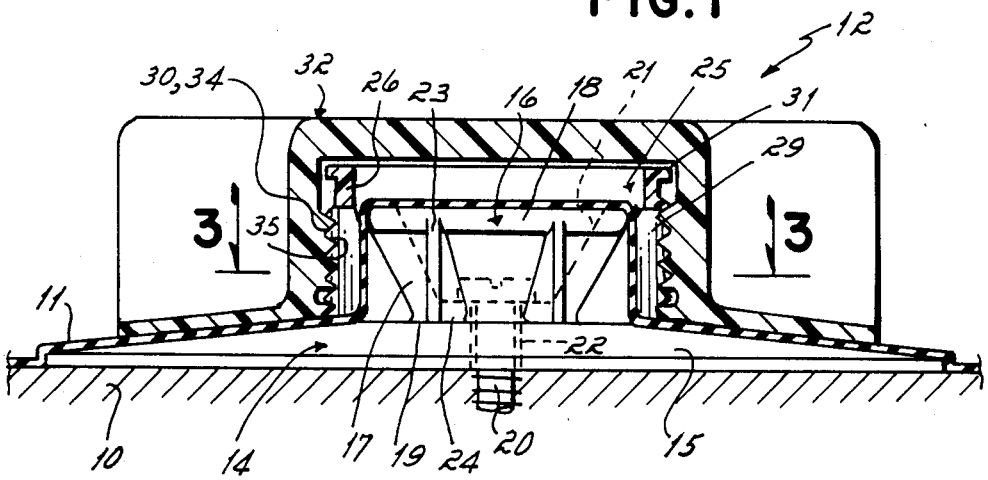
FIG. 2 is an elevational view of the fastener of this invention shown securing a membrane to a roof, with the cover, tined cap and membrane in cross-section.

As shown in FIG. 1, there is a roof surface 10 to which a membrane 11 is to be secured. The roof surface can be formed from a variety of different substances such as foamed concrete, plywood or sheet metal. The roofing membrane 11 is held in position on the roof surface 10 by a three piece non-penetrating fastener 12 formed from plastic such as polyvinyl chloride, nylon or polyester.

Fastener 12 includes a base or anchor disc 14. Anchor disc 14 includes a flat disc or base 15 and an inverted frusto-conical stub, projection or button 16 extended upwardly from the base 15. Wall 17 of button 16 is sloped radially outward from the base 15 so that the top or rim 18 of the button is wider than its bottom portion 19. The button 16 further includes a hollow interior 21 adapted to receive the head of a screw or nail 20. A hole 22 extends within the interior 21 directly through the center of the base 15. The hole is adapted to permit the shank of a screw or nail to pass through but to prevent the head of the screw or nail from passing through.

The anchor disc 14 further includes a plurality of spaced, vertical ribs 23 extending from the base 15 upwardly along the wall 17 to the rim 18 of button 16. The ribs 23 are equally spaced around the perimeter of the wall 17 to provide radial areas 24 or "pie shaped" segments between adjacent ribs.

The membrane 11 is held to the anchor disc 14 by means of a ring shaped retainer. The retainer 25 has a continuous upper band portion 26 and a lower skirt portion 27 formed by a plurality of tines 28. The number of individual tines 28 corresponds to the number of radial areas 24 on anchor 14 so that one tine is adapted to fit into each segment 24 between two adjacent ribs. Correspondingly, the spaces 29 between adjacent tines, as will be described, receive individual ribs 23.

The upper band portion 26 of the retainer 25 includes an annular ridge or thread 31. This thread is adapted to engage a special groove 40 of the fastener cover 32 discussed below and provides a means to temporarily attach the cover to the retainer without inhibiting or preventing outward flexing of the individual tines (See FIG. 9). The interior surface 33 as well as the exterior surface 34 of the retainer 25 is flared outwardly from top band 26 to its bottom to facilitate placement of the retainer over the button 16 and the membrane 11 without rupturing the membrane. The exterior 34 of the retainer, that is the external surface of each tine portion includes external threads 30 also adapted to be engaged by the internally threaded cavity in cover 32. (Although less preferred, a retainer cap made in accordance with the disclosure of U.S. Pat. No. 4,519,175 can be used in place of retainer 25.)

The third portion of the fastener 12 is the cover 32. The cover includes internal threads 35 which are adapted to screw onto the external threads 30 of the tined retainer 25 forcing the tines inwardly. The cover 32 further includes a peripheral flange 36 which when screwed down on the retainer will tend to flatten the membrane trapped beneath it. Further the cover 32 may include two (or more) radially extended fins 37 which facilitate turning the cap when it is screwed onto the retainer as well as lesser ribs (not shown) to reinforce the surface against bending. Further cover 32 has a groove 40 separate from the threads adapted to receive the annular ridge 31 of retainer.

In a preferred embodiment as shown in FIG. 9 the cap is preattached to the retainer by interengaging the thread 31 into groove 40. More specifically, the cover 32 is force fitted onto the retainer so that the internal groove 40 of the cover engages the upper ridge or thread 31 of the retainer 25. In this manner, the cover engages only the upper portion 26 of the retainer 25 and does not interfere with the flexibility of the individual tines 28.

Figure 3:
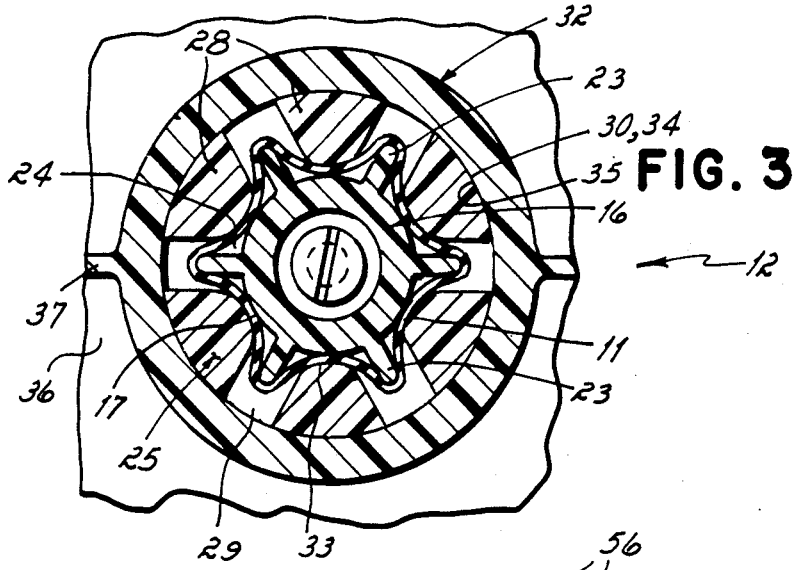
FIG. 3 is a cross sectional view taken generally at lines 3—3 of FIG. 2.

To fasten a membrane to a roof a plurality of the anchor discs 14 are fastened to the roof surface 10 by a nail or screw 20 extending through the hole 22 through the center of the anchor. After a sufficient number of these have been secured to the roof the membrane is placed over the anchor discs. The tined retainer 25, attached to the cover 32, is then forced down over the button 16 typically by stepping on the cover 32. The retainer 25 and button 16 should be angularly aligned prior to engagement such that the retainer tines 28 are positioned above the button areas 24. When so aligned the individual tines will move vertically into the areas 24 between adjacent ribs 23 when the retainer is placed on the buttons thereby avoiding engagement of the tines and ribs and possible damage to the membrane when securing the retainer in place over the button. The retainer 25 is provided with an appropriate number of tines so that only one tine fits between two adjacent ribs (see FIG. 3). The upper solid band portion 26 permits the tines 28 to flex radially outwardly such that the threads on adjacent tines remain horizontally aligned when flexed. Stepping on the cover to force the retainer over the button also forces the retainer further into the cover to enable the threads in the cover to engage the threads of the retainer. The cover is then screwed over the external threads 30 of the lower portion of the retainer forcing the tines and membrane further inwardly into the areas 24 between ribs 23 which thereby prevents rotation of the retainer since rotation of the retainer would cause the tines to engage the ribs. Screwing the cover 32 over the retainer compresses the individual tines and membrane beneath the rim 18 of the button preventing the retainer from popping off thereby holding the membrane sandwiched between the retainer and the anchor disc. An advantage of the ribs is that they prevent the membrane from bunching or the retainer from turning as the cover 32 is screwed onto the retainer.

To facilitate proper alignment of the retainer ring and specifically the individual tines with respect to the individual ribs of the button various alternate embodiments of the anchor disc are provided which provide for visually and/or tactually locating the individual ribs and aligning the ribs and the tines.

Figure 7:
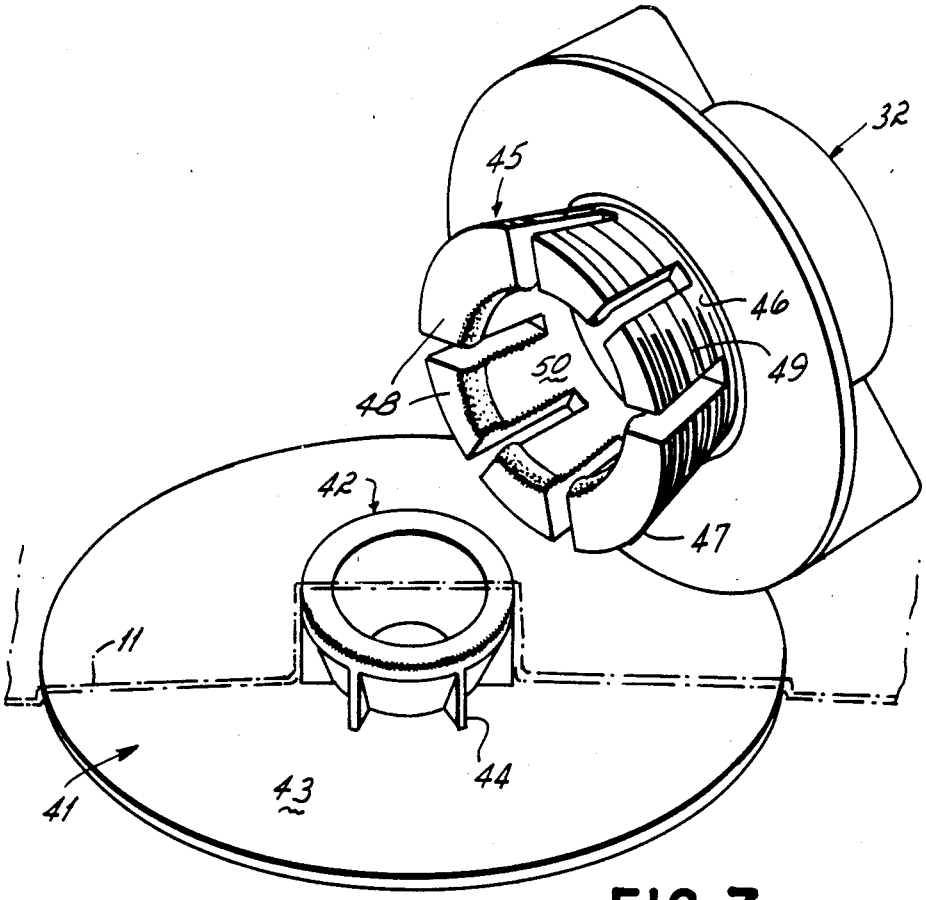
FIG. 7 is an isometric view of another alternate embodiment of an anchoring disc for use in the present invention wherein the button has a cross sectional elliptical configuration.
Figure 8:
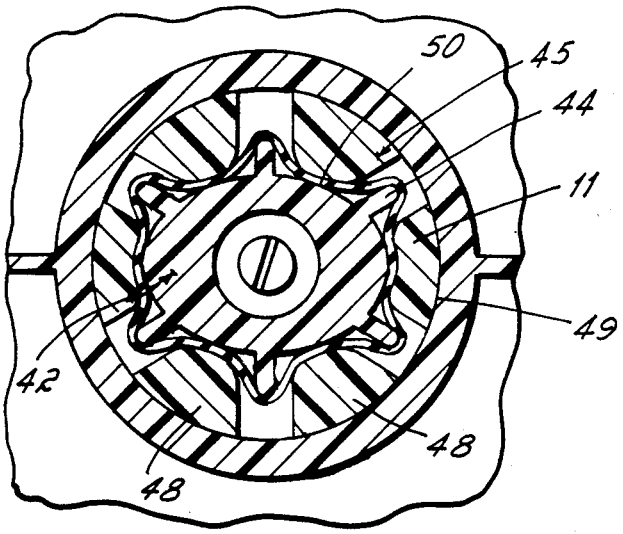
FIG. 8 is a cross sectional view similar to FIG. 3 but using the alternate anchoring disc of FIG. 7.

In the alternate embodiment shown in FIGS. 7 and 8 an anchor disc 41 is provided with an inverted frusto-conical oval button 42 and a circular base 43 having a plurality of ribs 44 spaced about its perimeter extending up to the button. (Optionally the ribs may be omitted and the mating oval surfaces used to preclude rotation.) As best seen in FIG. 8, the button 42 has a horizontal cross sectional configuration which is non-circular, preferably elliptical. A retainer 45 is provided with an upper ring or band portion 46 and a lower depending skirt 47 having tines 48. The retainer 45 has a circular threaded exterior surface 49, but has a non-circular, preferably elliptical, interior surface 50 adapted to mate with the exterior of button 42.

Thus, when a membrane is being fastened to a roof the anchors 41 are again fastened to the roof and the anchors are covered with a membrane. The retainers 45 are then positioned over the buttons 42 of the anchors 41 with their respective non-circular configurations aligned. Due to the mating configuration of the elliptical internal surface 50 of the retainer 45 and the elliptical external surface of the button 42, the retainer can readily be properly positioned over the button. Thus proper orientation of the retainer relative to the button, and alignment between the ribs and the tines, is easily accomplished. Since the non-circular configuration of the button itself prevents rotation of the cap, the rib can be eliminated. This, however, is a less preferred embodiment since the ribs also accommodate the uniform folding of rubber.

Figure 4:
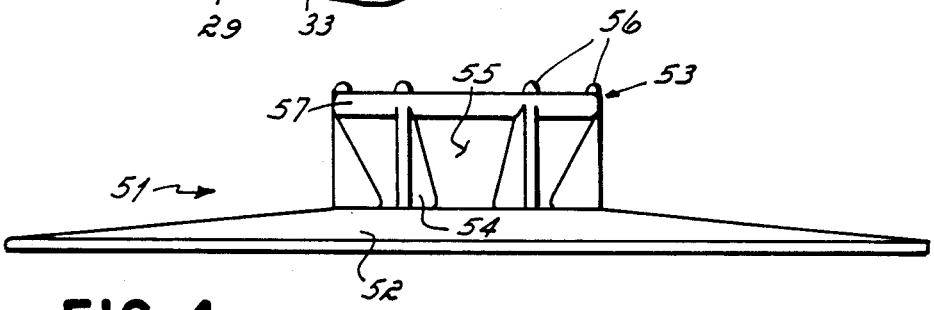
FIG. 4 is a side elevational view of one embodiment of an anchoring disc for use in the present invention.
Figure 4A:
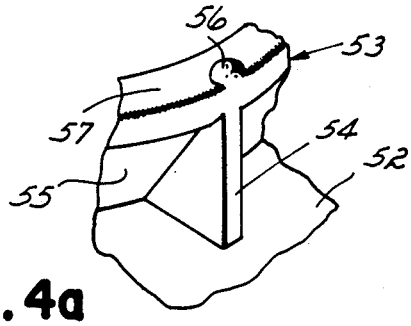
FIG. 4*a* is a fragmentary perspective view of the top of the anchoring disc of FIG. 4.

The alternate embodiment shown in FIGS. 4 and 4*a* has an anchor 51 having a base 52 and an upwardly extending inverted frusto-conical button 53. Also there are a plurality of ribs 54 which extend from the base 52 upwardly along the external wall 55 of the button 53. To visually and/or tactually locate these ribs when the membrane is covering the individual anchors fastened to a roof surface, a plurality of bosses 56 are provided on the upper rim 57 of the button 53. A boss 56 is located directly above each rib 54 so that once the anchor is covered with the membrane the location of the ribs can be detected by simply visually inspecting and/or touching the top of the button and feeling the bosses. This will provide a means to align the tined retainer over the button 53 so that the tines are positioned between adjacent ribs.

Due to the fact that the internal surface of the lower end of the retainer is smaller than the upper rim of a button, it may be difficult to force the retainer over the button. Accordingly, in an alternate embodiment shown in FIG. 5 an anchor disc 61 is provided which includes again a base 62 and an upwardly extending inverted frusto-conical button 63 with ribs 64 extending upwardly from the base 62 along an outer wall 65 of button 63. The button 63 includes an upper rim 66 which is tapered upwardly and inwardly toward the center of the button 65 so that when a retainer is forced over the button with the membrane therebetween the conically shaped rim 66 acts to guide the tines outwardly.

Figure 5:
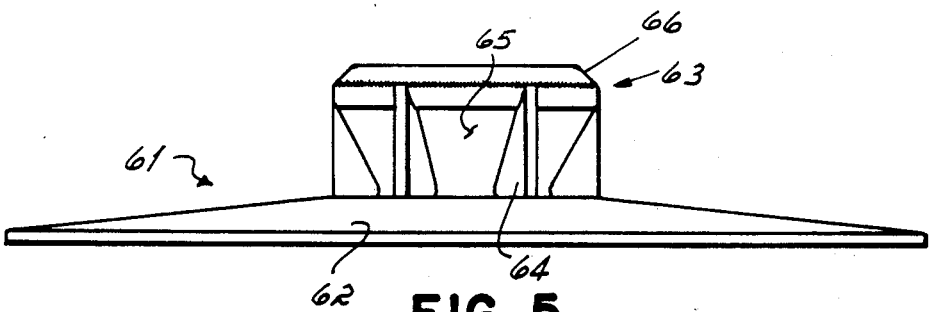
FIG. 5 is a view similar to FIG. 4 of an alternate embodiment of an anchoring disc for use according to the present invention.

The alternate embodiment shown in FIG. 4 and the alternate embodiment of FIG. 5 can be combined in one embodiment as shown in FIGS. 6 and 6*a*. As shown in FIG. 6 there is a specially adapted anchor 71 which includes a base 72, an upwardly extended inverted frusto-conical button 73 with a plurality of ribs 74 extending from the base 72 upwardly along the external wall 75 of button 73. Button 73 also includes an upwardly and inwardly tapered rim 76 and a plurality of bosses 77 which protrude above the rim 76. Again, the bosses are located directly above the location of the ribs to provide a means to visually and/or tactually locate the ribs after the membrane has covered the anchor.

It should be noted that the present invention provides a means to prevent the retainer from rotating with respect to the anchor or button when a cover is being screwed onto the retainer. As previously described, when the retainer is forced over the button of the anchor disc with the membrane trapped therebetween, the individual tines will engage the ribs of the anchor when the cover is being rotated thus preventing further rotation of the retainer. This prevents bunching and ripping of the membrane. Further, by providing mating non-circular shaped button and retainer, or a button with bosses extending above each rib, one can, visually and/or by touch, align the retainer tines between the button ribs prior to forcing the retainer over the button when the membrane is covering the anchor discs.

Further the unique configuration of the retainer facilitates screwing the cover over the retainer and the tined portions of the retainer without the threads on adjacent tines being misaligned. Since a portion of the vertical wall of the retainer is solid, that is the upper ring portion, when the retainer is forced down over the button the tines cannot move directly upwardly beyond the top of the retainer. Thus the threaded portion of adjacent tines remain aligned. Further with the ridge extending from the very upper portion of the retainer the cover can be pre-threaded to the retainer at the location the fasteners are fabricated. This provides for a rapid positioning of the retainer and cover over the cap. Since the pre-threaded cap and retainer are connected only at the upper portion of the retainer it does not interfere with the flexing of the tines.

Thus the present invention provides numerous different advantages which greatly enhance one's ability to fasten a membrane to a roof or other structure with a non-penetrating type fastener without damaging the membrane.

Thus having described my invention, I claim:

1. A fastener for holding a roof membrane to a roof without puncturing the roof membrane comprising:

an anchor, said anchor including a base portion and a central inverted frusto-conical button;

said button extended upwardly from said base portion and having an outwardly sloped external surface;

an externally threaded tined retainer adapted to snap onto said button with said membrane held therebetween;

an internally threaded cover adapted to screw over said externally threaded retainer to hold said retainer and said button engaged with said membrane gripped therebetween;

said anchor further including means to prevent rotation of said retainer relative to said button.

2. The fastener claimed in claim 1 wherein said means to prevent rotation of said retainer comprises a plurality of ribs extending from said base to said external surface of said button and wherein said externally threaded tined retainer includes a plurality of spaced tines, said tines adapted to fit between adjacent ribs when fitted over said button and membrane.

3. The fastener claimed in claim 2 wherein said button includes means to tactually locate said ribs.

4. The fastener claimed in claim 2 wherein said button includes means to visually locate said ribs.

5. The fastener claimed in claim 3 wherein said means to tactually locate said ribs includes a plurality of bosses corresponding in number to the number of said ribs, each of said bosses being located on said button above a different one of said ribs.

6. The fastener claimed in claim 1 wherein said button includes an inwardly and upwardly tapered rim.

7. The fastener claimed in claim 4 wherein said button includes an inwardly and upwardly tapered rim.

8. The fastener claimed in claim 1 wherein said tines are outwardly flared to reduce flexing of said tines when engaged with said button.

9. The fastener claimed in claim 1 wherein said button has an non-circular horizontal cross sectional configuration and said retainer has a non-circular mating cavity so that when mated the tines of said retainer are aligned with the spaces between said ribs of said button.

10. The fastener claimed in claim 9 wherein said externally threaded tined retainer includes an external peripheral surface and an internal surface wherein said external peripheral surface has a round horizontal cross sectional configuration and said internal surface has an non-circular horizontal cross sectional configuration adapted to mate with said button wherein said retainer has a circular exterior threaded surface.

11. The fastener claimed in claim 1 wherein said externally threaded tined retainer includes a solid upper band portion and a lower tined portion.

12. The fastener claimed in claim 11 wherein said upper band portion includes an external peripheral ridge adapted to engage an internal groove in said cover.

13. A fastener for holding a roofing membrane to a roof without puncturing the roofing membrane comprising:

an anchoring disc, said disc including a base portion and a central hollow inverted frustoconical button extended from said base portion;

said central inverted frusto-conical button having a non-circular cross sectional configuration;

an externally threaded tined retainer adapted to snap onto said button of said anchoring disc with said membrane held therebetween, said retainer having an internal surface and an external surface;

said external retainer surface having a circular horizontal cross sectional configuration and said internal retainer surface having a non-circular horizontal cross sectional configuration adapted to mate with said button;

an internally threaded cover adapted to screw onto said externally threaded retainer to hold said retainer and said button engaged with said membrane gripped therebetween.

14. The fastener claimed in claim 13 wherein said anchor includes a plurality of ribs extended from said base to said external surface of said button.

15. The fastener claimed in claim 14 wherein said tines of said externally threaded tined retainer are spaced to provide for location of one tine between each two adjacent ribs when said retainer is fitted over said button.

16. The fastener claimed in claim 14 wherein said button includes an inwardly and upwardly tapered rim.

17. The fastener claimed in claim 13 wherein said externally threaded tined retainer includes an outwardly flared tined portion.

18. A fastener for holding a roofing membrane to a roof without puncturing the roofing membrane comprising:

an anchor including a base portion and a central, inverted, frusto-conical button extended from said base portion;

an externally threaded tined retainer adapted to snap onto said button of said anchor with said membrane held therebetween;

said retainer including a top portion and and upper continuous annular solid band portion extended downwardly from said top portion and a plurality of tines extending downwardly from said band portion, said tines adapted to engage said button with said membrane held therebetween;

an internally threaded cover adapted to screw onto said externally threaded tined retainer to hold said tined retainer and button engaged with said membrane gripped therebetween.

19. The fastener claim 18 wherein said cover includes a lower groove and said band portion includes a peripheral ridge adapted to engage said groove in said cover without interfering with the flexibility of said tines to thereby permit preassembly of said retainer and cover with said ridge engaging said groove.

* * * * *